US005927661A

United States Patent [19]

Tinsley et al.

[11] Patent Number: 5,927,661

[45] Date of Patent: Jul. 27, 1999

[54] BOTTLE SUSPENSION APPARATUS

[76] Inventors: Kevin L. Tinsley; Liana Peters-Tinsley, both of 523 S. Plymouth Ct., Chicago, Ill. 60605

[21] Appl. No.: 08/872,760

[22] Filed: Jun. 5, 1997

[51] Int. Cl.[6] ..... A47D 15/00; A44B 1/18

[52] U.S. Cl. ..... 248/102; 248/205.2

[58] Field of Search ..... 248/102, 103, 248/104, 105, 106, 205.2; 106/36

[56] References Cited

U.S. PATENT DOCUMENTS

| | | | |
|---|---|---|---|
| 1,013,221 | 1/1912 | Roush | 248/102 |
| 1,136,529 | 4/1915 | Hopwood | 248/102 |
| 1,559,740 | 11/1925 | Cardarella | 248/102 |
| 1,630,167 | 5/1927 | Cardarella | 248/102 |
| 2,050,841 | 2/1936 | Houghton | 248/102 |
| 2,182,164 | 12/1939 | Rosenberg | 248/102 |
| 2,199,869 | 5/1940 | Baker et al. | 248/102 |
| 2,214,882 | 1/1940 | Eades | 248/102 |
| 2,399,320 | 4/1946 | Brose et al. | 248/102 |
| 2,462,187 | 2/1949 | Helixon | 248/102 |
| 2,490,207 | 12/1949 | Cassile | 248/102 |
| 2,518,862 | 8/1950 | Cain et al. | 248/102 |
| 2,991,032 | 7/1961 | Theis | 248/102 |
| 3,058,708 | 10/1962 | Murray et al. | 248/102 |
| 4,001,904 | 1/1977 | Gill | 7/14.6 |
| 4,062,510 | 12/1977 | Brochu | 248/102 |
| 4,096,977 | 6/1978 | Barville et al. | 248/102 |
| 4,537,341 | 8/1985 | Kelly | 224/202 |
| 4,630,793 | 12/1986 | Hunter | 248/102 |
| 4,750,696 | 6/1988 | Shan-Liang | 248/103 |
| 5,613,657 | 3/1997 | Olaiz | 248/102 |
| 5,704,505 | 1/1998 | Singh | 248/104 |

FOREIGN PATENT DOCUMENTS

| | | | |
|---|---|---|---|
| 476390 | 9/1947 | Canada | 248/102 |

OTHER PUBLICATIONS

*Twins Magazine,* May/Jun. 1997, cover page, pp. 3, 12, and 55.

Summer Infant Products, Inc., Infant Carrier Play Center, copy of packaging, instruction sheet, product brochure (Sep. 1996).

*Primary Examiner*—Derek J. Berger
*Assistant Examiner*—Michael Nornberg
*Attorney, Agent, or Firm*—Bell Boyd & Lloyd

[57] ABSTRACT

A bottle suspension apparatus secured to the handle of a baby car seat for suspending a bottle in a suitable position adjacent to the baby's mouth to enable the baby to drink from the bottle without the need for a person to continuously hold the bottle and which maintains the bottle in a tilted position to direct the fluid in the bottle into the nipple and thereby minimize the amount of air taken in by the baby. The bottle suspension apparatus provides sufficient tension to maintain the bottle's nipple in the baby's mouth even if the baby makes slight movements but is sufficiently flexible to allow the baby to remove or displace the nipple from the baby's mouth when the baby is done drinking and/or when the baby is choking or gagging.

9 Claims, 1 Drawing Sheet

BOTTLE SUSPENSION APPARATUS

DESCRIPTION

This invention relates in general to a bottle suspension apparatus, and more particularly to a baby bottle suspension apparatus which is attachable to a baby car seat for holding a bottle in a suitable position to allow a baby sitting in the car seat to drink from the bottle.

BACKGROUND OF THE INVENTION

Parents and other caretakers spend a considerable amount of time feeding babies or infants with baby bottles containing formula, milk, juice, water, or other liquids. Generally, bottle feeding babies requires the use of two hands, one hand to hold the baby and one hand to continuously hold the bottle in the correct position to allow the baby to drink. The position of the bottle is important because it is undesirable to let the baby take in too much air while drinking. To minimize the amount of air which the baby takes in, the bottle must be positioned to maintain the nipple of the bottle filled with liquid as the amount of liquid in the bottle decreases. Depending on the shape of the bottle, this usually requires tilting the bottle at the appropriate angle depending on the amount of liquid in the bottle.

In recent years, due to developing technology, our mobile society, and various legal requirements, baby car seats have become a prevalent device for holding and transporting babies. Heretofore, it has been well known to use blankets, pillows, and the like to prop a baby bottle in a position which allows the baby sitting in the car seat to drink from the bottle without the need for a person to hold the baby or the bottle. Bottles positioned using such devices have to be re-adjusted to prevent air from filling the nipples and are easily displaced by even slight movements by the baby. Accordingly, there is a need for a bottle holding device which attaches to a baby car seat, which holds the bottles in a suitable position to allow a baby sitting in the car seat to drink from the bottle, which eliminates the need for a person to continuously hold and/or re-adjust the bottle, which allows the baby to make slight movements without displacing the bottle, which allows the baby to displace the bottle from its mouth to prevent choking or gagging, and which minimizes the intake of air during feeding.

SUMMARY OF THE INVENTION

The present invention overcomes the above problems in providing a bottle suspension device which is removably and adjustably attachable to the handle of a baby car seat to hold or suspend a bottle in a suitable position adjacent to the baby's mouth to enable the baby to drink from the nipple of the bottle without the need for a person to hold the baby or the bottle. The bottle suspension apparatus of the present invention positions the bottle with sufficient tension to maintain the bottle's nipple in the baby's mouth and to compensate for slight movements in the baby's head. At the same time, the bottle suspension apparatus is sufficiently flexible to allow the baby to remove or displace the nipple from the baby's mouth when the baby is done drinking and/or when the baby is choking or gagging. The bottle suspension apparatus additionally compensates for the constant change in weight and distribution of the fluid in the bottle as the fluid in the bottle is consumed by the baby and thereby minimizes the amount of air the baby takes in during feeding.

The bottle suspension apparatus or device of the present invention generally includes a centrally located elastic band or body for securely gripping the bottle, cloth extension arms projecting from each side of the body, and an elastic attaching strap or hand transversely connected to the end of each arm opposite the band. The attaching straps have suitable fasteners for adjustably securing the device to the handle of the baby car seat. The baby bottle is inserted into the elastic band in a suitable suspended position to allow the baby to drink from the nipple of the bottle. As the amount of liquid in the bottle decreases, the extension arms and the elastic attaching straps coact to exert an upward force on the end of the bottle opposite the nipple, thereby tilting the bottle to maintain fluid in the nipple. Likewise, the band, the extension arms, and the attaching straps coact to exert a sufficient amount of tension on the bottle to compensate for slight movements by the baby without displacement of the nipple from the baby's mouth, but which allows the baby to remove the nipple if the baby is choking or gagging. Additional extension arms and attaching straps could be connected to the elastic band and/or extension arms to support the bottle.

It is therefore an object of the present invention to provide a bottle suspension apparatus which holds a bottle in a position adjacent to a baby's mouth.

A further object of the present invention is to provide a bottle suspension apparatus which is removably attachable to a baby car seat and which is adapted to hold a baby bottle in a position adjacent the baby's mouth.

A further object of the present invention is to provide a bottle suspension apparatus attachable to a baby car seat which enables a baby to drink from the bottle without the need for a person to continuously hold and/or re-adjust the bottle.

A further object of the present invention is to provide a bottle suspension apparatus attachable to a baby car seat which is sufficiently flexible to allow the baby to remove the nipple of the bottle from the baby's mouth.

A further object of the present invention is to provide a bottle suspension apparatus for a baby car seat which compensates for slight movements by the baby without displacement of the nipple from the baby's mouth.

A still further object of the present invention is to provide a bottle suspension apparatus which minimizes the amount of air the baby intakes during feeding.

Another object of the present invention is to provide a bottle suspension apparatus attachable to a baby car seat which is simple to construct, durable, and machine washable.

Other objects, features and advantages of the invention will be apparent from the following detailed disclosure, taken in conjunction with the accompanying sheet of drawings, wherein like reference numerals refer to like parts.

DESCRIPTION OF THE INVENTION

Figure 1:
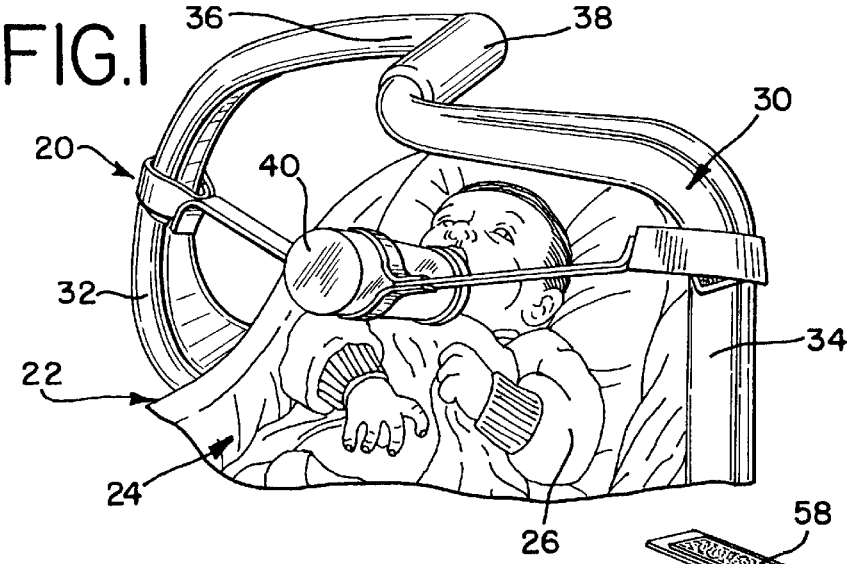
FIG. 1 is a perspective view of the bottle suspension apparatus of the present invention mounted on a baby car seat and holding a bottle in position which allows a baby sitting in the car seat to drink from the bottle.
Figure 2:
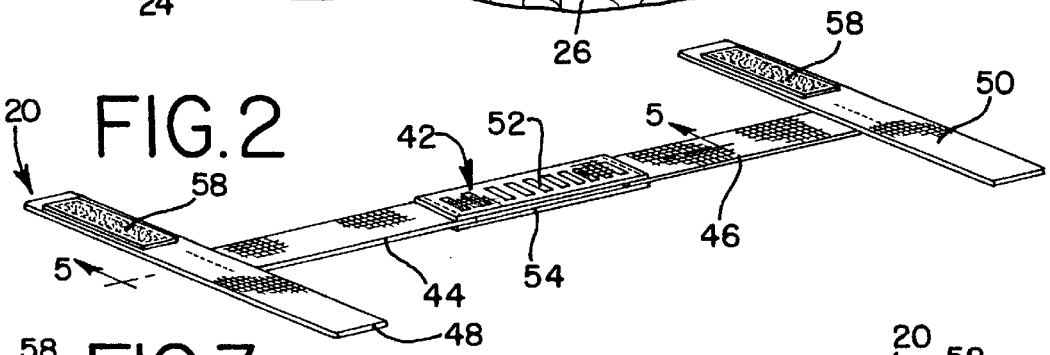
FIG. 2 is a perspective view of the bottle suspension apparatus of the present invention.
Figure 3:
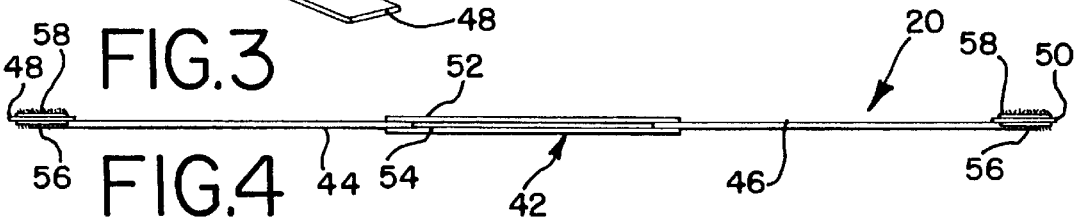
FIG. 3 is a side view of the bottle suspension apparatus.

Referring now to the drawings, and particularly to FIG. 1, the bottle suspension device or apparatus of the present invention, generally indicated by numeral 20, is adapted to be mounted on a baby car seat 22 to suspend a bottle in a position adjacent to the baby's mouth to enable the baby to drink from the bottle without the need for a person to continuously hold the bottle. The conventional baby car seat 22 has a cushioned basket 24 suitably configured and sized to hold an infant or baby 26 in a reclined position. An upside-down U-shaped handle 30 is pivotally attached to opposite sides of the basket 24. The handle 30 includes two downwardly extending spaced apart handle members 32 and 34 and a horizontally extending connecting bar 36 integrally formed with the members 32 and 34. Each member 32 and 34 is pivotally attached to the basket 24 to facilitate backward rotation of the entire handle 30 from the upright position illustrated in FIG. 1 to a position behind the basket 24. The conventional baby car seat includes suitable locking mechanisms (not shown) for releasably locking the handle in the upright position as well as the position behind the basket. The handle 30 may also include a suitable grasping portion 38 in the connecting bar 36 which facilitates picking up the car seat 22 with one hand.

Turning now to FIGS. 1 to 5, the bottle suspension apparatus 20 of the present invention includes an elastic band or body 42 for securely gripping and holding the bottle 40, two cloth extension arms 44 and 46 projecting from opposite sides of the body 42, and two elastic attaching straps or hands 48 and 50, respectively, connected to the ends of the arms 44 and 46 opposite the body 42 for securing the bottle suspension apparatus 20 to the handle 30 of the car seat 22. The bottle suspension apparatus 20 is adapted to suspend a baby bottle on a car seat in a suitable position to maintain the nipple of the bottle in the baby's mouth. It should be appreciated that the size and dimensions of the bottle suspension apparatus could vary to accommodate various size bottles and car seats in accordance with the present invention.

More specifically, the bottle holding band or body 42 includes two spaced-apart strips of elastic material 52 and 54 sewn together at each end to form a substantially cylindrical sleeve which is adapted to receive and grip or hold the bottle 40. The strips are sized such that they must be stretched to fit over the outer circumference of the bottle when the bottle is inserted in the body 42, thereby forming a tight hold or grip on the bottle, as illustrated in FIG. 1. At least the inner surfaces of the top and bottom strips 52 and 54 of the elastic band 42 may be formed with a suitable abrasive anti-sliding anti-rotating pattern which engage the bottle to increase the frictional gripping power of the body 42. The combination of the forces created by the stretching of the elastic material over the bottle 40 and the additional frictional forces created by the abrasive pattern on the body 42 substantially fix the body 42 on the bottle at the desired position such that small forces placed on the nipple by the baby will not cause movement of the bottle relative to the elastic band 42, displacement of the bottle from the band, or significantly alter the position of the bottle relative to the baby's mouth. In one configuration, each elastic strip 52 and 54 may be approximately four inches long and one inch wide, although any suitable width and length may be used. Likewise, it should be appreciated, that the body 42 could be formed from a single elastic strip, multiple elastic strips, or from other suitable materials.

Figure 5:
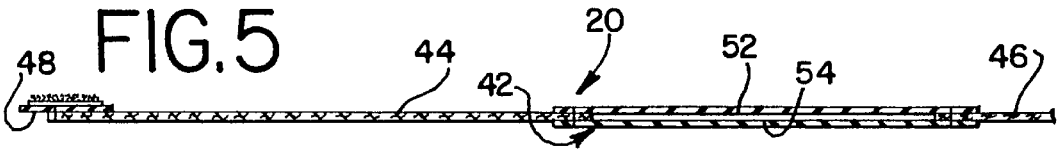
FIG. 5 is a fragmentary cross-sectional view of the bottle suspension apparatus taken substantially along line 5—5 of FIG. 2.

The extension arms 44 and 46 project from opposite sides of the body 42 in substantially the same longitudinal plane as the body. In particular, and for ease of assembly, one end of the extension arm is inserted between the ends of the top and bottom elastic strips 52 and 54. All three ends are then sewn together with one or mores sets of stitches, as illustrated in FIG. 5. The extension arms are made from one or more relatively strong non-elastic (i.e. substantially non-stretchable) flexible strips of cloth material such as cotton, although it should be appreciated that the arms could be made from other suitable stretchable or non-stretchable materials. Each extension arm 44 and 46 may be approximately five to six inches long and one inch wide, although any suitable width and length may be used.

Figure 4:
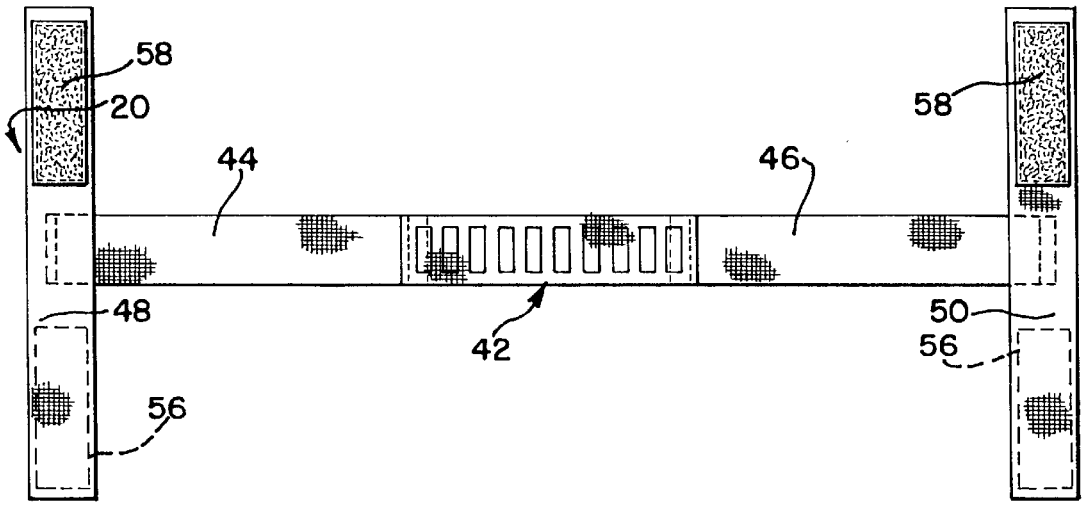
FIG. 4 is a top plan view of the bottle suspension apparatus.

The attaching straps or hands 48 and 50 are made from elastic strips which are connected to the ends of the extension arms 44 and 46, respectively, opposite the ends attached to the body 42. The attaching hands 48 and 50 extend transversely to the longitudinal plane of the body 42 and the extension arms 44 and 46. The end of the extension arm is sewn to the center of one side of the attaching hand, as illustrated in FIG. 4. Each attaching hand includes a fastener such as an adjustable hook and loop type fastener, commonly sold under the trademark VELCRO®, for securing the attaching hand about the handle members 32 and 34, although it should be appreciated that other suitable fasteners could be used. The hook portion 56 is sewn onto the inner side of the attaching hand 48 on one side of the extension arm 44 and the loop portion 58 is sewn onto the outer side of the attaching hand 48 on the opposite side of the extension arm 44 such that the hook and loop portions are in engagement when the attaching hand is wrapped around the handle member 32, as illustrated in FIG. 1. The hook and loop portions are sufficiently sized to allow easy adjustment of the attaching hands around the handle members. The attaching hands 48 and 50 may be approximately seven to eight inches long and one inch wide, although any suitable width and length may be used. It should be appreciated that the attaching hands could be made from a non-elastic or non-stretchable material.

In operation, the suspension apparatus 20 is mounted on a car seat, the sleeve members 52 and 54 are separated, a bottle is inserted, and the sleeve member is adjustably positioned along the bottle to apply a light force on the nipple toward the baby's mouth. To create an upward force on the end of the bottle opposite the nipple, the attaching hands are secured to the handle members 32 and 34 above the bottle, as illustrated in FIG. 1. This constant upward force acts to tilt the end of the bottle opposite the nipple upwardly which causes the liquid in the bottle to gravitationally flow into the nipple and thereby minimizes the amount of air taken in by the baby. This upward force compensates for the constant change in weight and distribution of liquid in the bottle as the liquid in the bottle is consumed to maintain liquid in the nipple at all times. The elastic body 42, the non-elastic extension arms 44 and 46, and the adjustable elastic attaching hands 48 and 50, coact to urge the bottle toward the baby and provide the bottle suspension apparatus of the present invention with sufficient tension to maintain the bottle's nipple in the baby's mouth if the baby makes slight movements. The combination of the elastic body, the arms, and the hands further allow lateral or horizontal movement of the bottle away from the baby and is thus sufficiently flexible to allow the baby to remove or displace the nipple from the baby's mouth when the baby is done drinking and/or when the baby is choking or gagging by turning its head or otherwise pushing the nipple out of its mouth.

The bottle suspension apparatus of the present invention could alternatively be formed with one or more additional supporting or extension arms securable to the connecting bar of the handle to support the bottle, especially for bottles containing a full eight or ten ounces of fluid. In one such embodiment, one end of an extension or supporting arm is connected to the top of the elastic strap 52 and the other end is connected to an attaching hand. The attaching hand is adjustably secured to the handle's connecting bar. Alternatively, the extension or supporting arm could include two straps which are respectively connected to the extension arms 44 and 46 at one end and an attaching hand at the other end. Likewise two or more separate extension or supporting arms could be individually attached between the extension arms 44 and 46 respectively, and the connecting bar 36 to support the bottle suspension apparatus. The supporting arm could be constructed from one or more strips of material.

The entire bottle suspension apparatus of the present invention is easily removable from the handle of the car seat and can be placed in a dishwasher or washing machine for cleaning and/or sterilization.

It will be understood that modifications and variations may be effected without departing from the scope of the novel concepts of the present invention, but it is understood that this application is to be limited only by the scope of the appended claims.

The invention is hereby claimed as follows:

1. A device for suspending a bottle on a baby car seat in a position adjacent to a baby's mouth to enable the baby to drink for the bottle, said baby car seat including a basket for holding the baby and a handle attached to said basket, said bottle having two ends and a nipple attached to one end, said device comprising:

a stretchable body adapted to grip the bottle formed from at least one strip of elastic material having an anti-sliding anti-rotating pattern thereon to increase the frictional gripping power of the body to the bottle, at least two extension arms, each said extension arm having one end connected to the body, and at least two stretchable attaching hands, each said attaching hand transversely connected to the end of said extension arm opposite the body, each said hand formed from at least one strip of elastic material and having hook and loop means for adjustably securing the device to said handle, whereby the stretchable body, the extension arms and the strechalbe attaching hands coact to apply a light force urging the nipple toward the baby's mouth and to apply an upward force on the end of the bottle opposite the nipple to cause any liquid in the bottle to gravitationally flow into the nipple and thereby minimize the amount of air taken in by the baby.

2. The device of claim 1, wherein the body is formed from two strips of elastic material sewn together at each end.

3. The device of claim 2, wherein the strips of elastic material are sized to stretch-fit over the bottle to form a tight grip on the bottle.

4. The device of claim 2, wherein the extension arms are sewn to the strips of elastic material.

5. The device of claim 1, wherein the extension arms are formed from a substantially non-stretchable material.

6. The device of claim 5, wherein the extension arms are a cloth material.

7. The device of claim 1, wherein the attaching hands are transversely sewn to the extension arms.

8. The device of claim 1, which further includes at least one supporting arm connected to said body and an attaching hand at the end of said supporting arm secured to the handle.

9. The device of claim 8, wherein the supporting arm is connected to at least one of said extension arms.

* * * * *